United States Patent [19]

Shirai et al.

[11] Patent Number: 4,597,533

[45] Date of Patent: Jul. 1, 1986

[54] ELECTROSTATIC SPRAYING APPARATUS

[75] Inventors: Hiroshi Shirai; Tsuneyasu Matsuhisa, both of Shizuoka, Japan

[73] Assignee: Fuji Photo Film Co., Ltd., Kanagawa, Japan

[21] Appl. No.: 502,061

[22] Filed: Jun. 7, 1983

[30] Foreign Application Priority Data

Jun. 10, 1982 [JP] Japan ..... 57-86627[U]

[51] Int. Cl.[4] ..... B05B 5/04

[52] U.S. Cl. ..... 239/701; 118/627; 239/290

[58] Field of Search ..... 239/690, 691, 697–701, 239/704, 290, 300; 361/225, 230, 233; 118/621, 623–628, 640; 427/13, 30

[56] References Cited

U.S. PATENT DOCUMENTS

| | | | |
|---|---|---|---|
| 2,773,472 | 12/1956 | Lamm | 118/628 X |
| 2,893,894 | 7/1959 | Ransburg | 239/703 |
| 3,964,683 | 6/1976 | Gimple | 239/691 X |
| 4,218,019 | 8/1980 | Baldwin et al. | 239/290 |

*Primary Examiner*—Andres Kashnikow

*Attorney, Agent, or Firm*—Sughrue, Mion, Zinn Macpeak & Seas

[57] ABSTRACT

An electrostatic spraying apparatus charges particles of a coating material to be emitted and sprays the same such that they become attracted to and deposited on a travelling web substrate. Electrode plates serve to repel the charged particles to thereby even the distribution of particles deposited on the web. An air flow may be used to additionally guide the particles or prevent them from adhering to the electrode plates.

5 Claims, 10 Drawing Figures

ELECTROSTATIC SPRAYING APPARATUS

BACKGROUND OF THE INVENTION

The present invention relates to an electrostatic spraying apparatus having electrode plates for repelling the charged particles of sprayed paint. More particularly, the invention relates to an improved rotary electrostatic spraying apparatus suitable for depositing paint on a broad travelling web.

Electrostatic spraying uses the principle of electrophoresis that electrically polarized particles are attracted to a grounded or oppositely charged surface. The conventional electrostatic spraying equipment consists of a spray booth and a disc, bell or gun type applicator that sprays the charged particles of paint onto articles suspended from hangers being transported on a conveyor rail. A metered amount of paint is supplied to the rapidly rotating disc, bell or gun; centrifugal force spreads the paint to the periphery of the disc or bell, or the needle tip of the gun, which is charged to a high negative potential, and on reaching the edge of the disc or bell, or the needle tip, the paint is atomized as a result of the influence of the concentrated electrostatic field at that point, and, as the article to be coated is grounded, the finely divided charged particles are attracted to its surface.

The present invention relates to an effort to modify the above-described rotary electrostatic spraying apparatus so as to apply a uniform coating in the transverse direction onto a broad travelling metal web.

The paint particles sprayed from the conventional rotary electrostatic coating machine provide a characteristic circular or annular pattern. The size of this spray pattern can be controlled by changing the distance between the rotating electrode and the article to be coated, but the paint deposition is not uniform in the direction of the width of a broad travelling web. This problem could be eliminated by reciprocating the coating machine in many directions, but this requires an elaborate coating system and increases the spray cost and maintenance.

SUMMARY OF THE INVENTION

Therefore, the primary object of the present invention is to provide an electrostatic spraying apparatus capable of continuous and uniform paint application in the transverse direction of a travelling web without requiring additional control operations such as the reciprocation of the machine.

This object of the present invention can be accomplished by a rotary electrostatic spraying apparatus having electrode plates positioned along the path of the flying paint particles to provide an electric field repelling said paint particles.

DETAILED DESCRIPTION OF THE PREFERRED EMBODIMENTS

Figure 1:
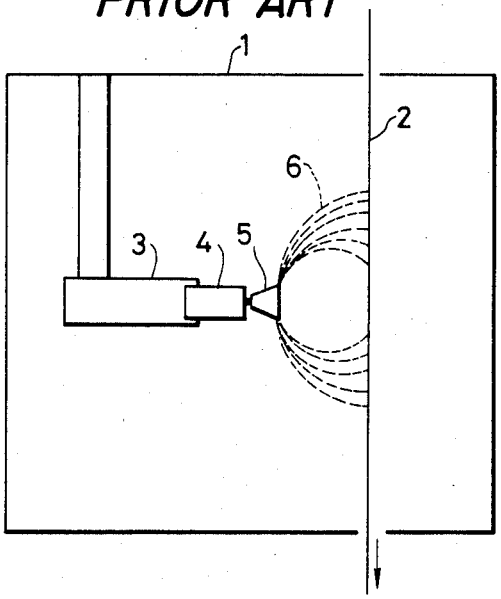
FIG. 1 PRIOR ART
FIG. 1 is a schematic side view showing a conventional rotary electrostatic spraying apparatus.
Figure 2:
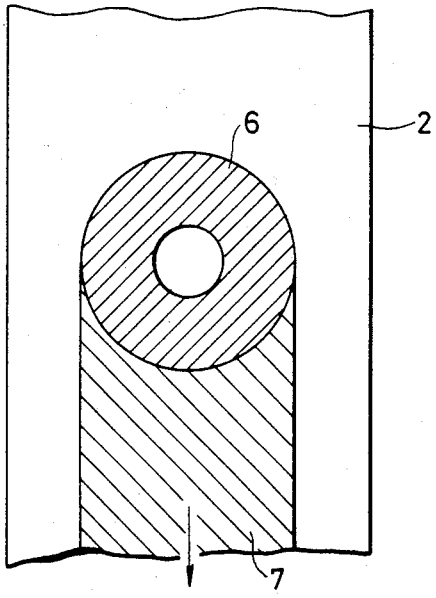
FIG. 2 PRIOR ART
FIG. 2 is a front view showing the pattern of a coating formed on broad travelling web by the apparatus of FIG. 1.
Figure 3:
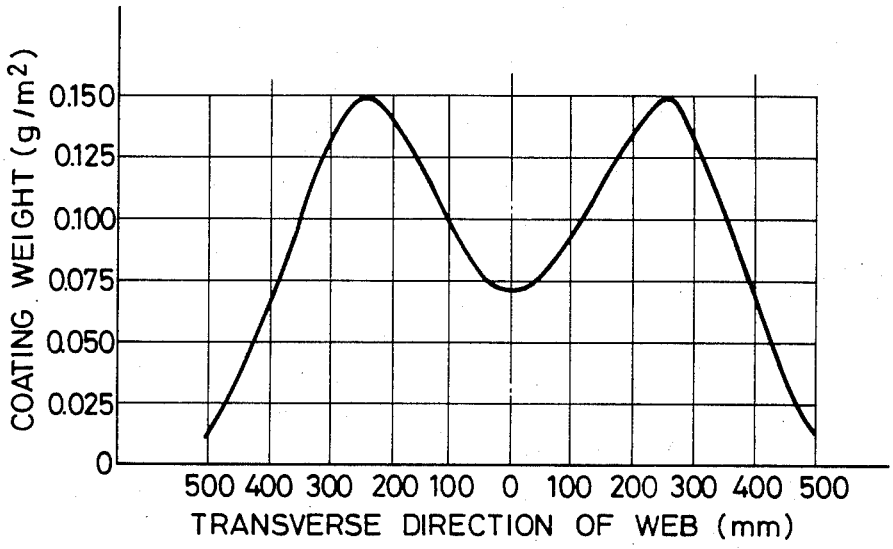
FIG. 3 PRIOR ART
FIG. 3 is a diagram showing the variation of paint deposition in the transverse direction of the web as provided by the apparatus of FIG. 1.

A typical example of the conventional rotary electrostatic spraying apparatus is shown in FIG. 1. In a spray booth 1, a broad metal web 2 travels in the direction indicated by the arrow. An insulated support 3 retains an air motor 4 at one end which rotates a negatively charged cup 5 which atomizes paint into charged particles 6 that are directed onto the web 2. The particles are deposited to form an annular pattern as shown in FIG. 2, and the resulting deposition 7 covers a small area and is uneven in the transverse direction of the web, as depicted in FIG. 3.

Figure 4:
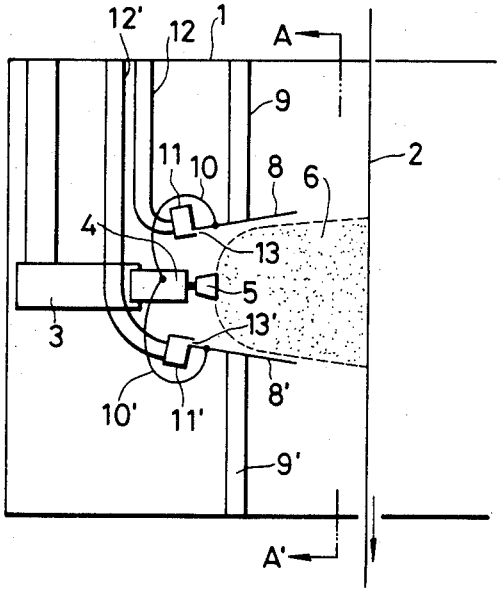
FIG. 4 is a schematic side view showing the rotary electrostatic spraying apparatus according to one embodiment of the present invention.
Figure 5:
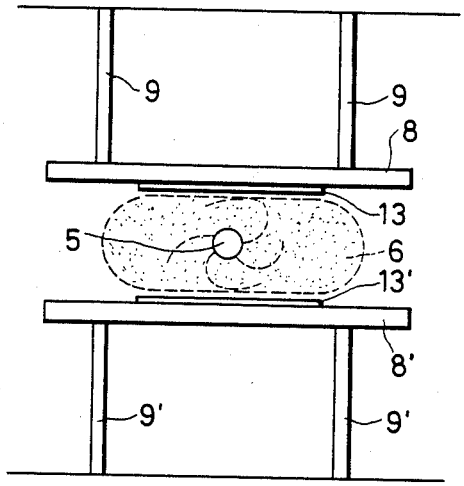
FIG. 5 is a front view of the apparatus of FIG. 4 seen in the direction indicated by arrows A–A'.

One embodiment of the rotary electrostatic spraying apparatus of the present invention is shown in FIGS. 4 and 5. It is characterized by having an electrode plate 8 (8') which is retained on an insulated support means 9 (9') and positioned in the vicinity of the cup 5 for forming an electric field that repels the flying charged particles of paint. The electrode plate 8 (8') is electrically connected to the air motor 4 by a wire 10 (10') and is charged to the same potential as the cup 5. One end of the electrode plate 8 (8') is attached to an air blowing tube 11 (11') that forms an air current around the center of the electrode 8 (8') in its transverse direction. An air pump (not shown) supplies air into an air duct 12 (12') and blows it along the electrode plate 8 (8') through an air outlet 13 (13') on the tube 11 (11'). Since the electrode plate 8 (8') is positioned in the path of the ascending (descending) charged particles of paint, it modifies the travel of the ascending (descending) particles to spread horizontally. Even if this correcting action of the electrode plate 8 (8') is incomplete, the ascending (descending) paint particles will not deposit on the plate 8 (8') thanks to the air currents formed around the center of the plate 8 (8') in the transverse direction thereof.

Figure 6:
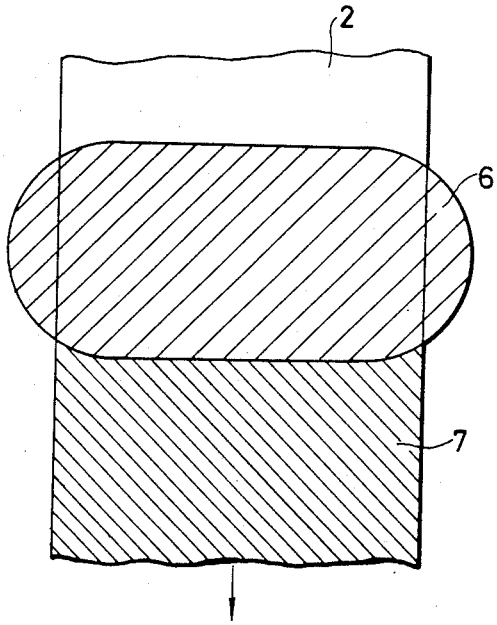
FIG. 6 is a front view showing the pattern of a coating formed on the travelling web by the apparatus of FIGS. 4 and 5.
Figure 7:
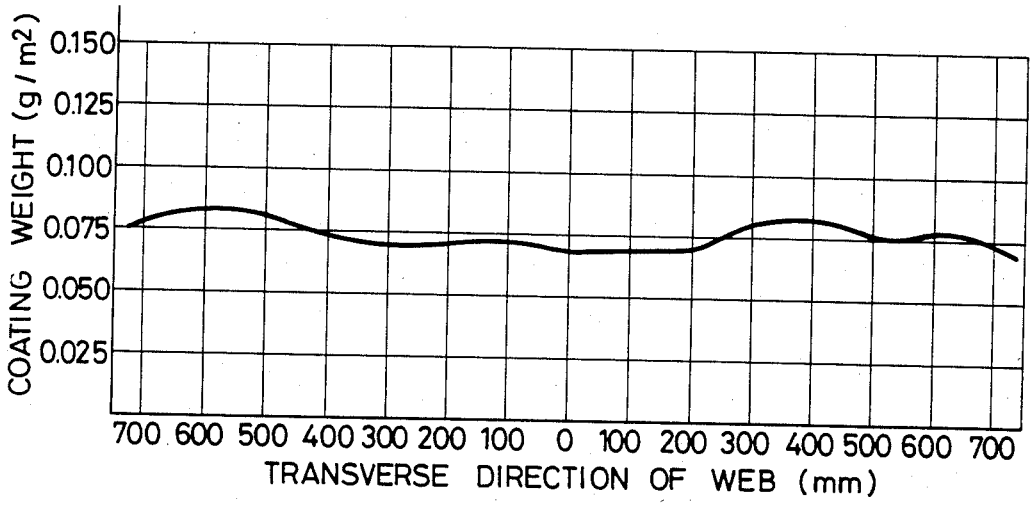
FIG. 7 is a diagram showing the variation of paint deposition in the transverse direction of the web as provided by the apparatus of FIGS. 4 and 5.

As shown in FIG. 6, the spray pattern provided by the apparatus of the present invention is an elongated ellipse, and as shown in FIG. 7, the deposition obtained covers the entire width of the running broad metal web and is uniform in coating weight.

Figure 8:
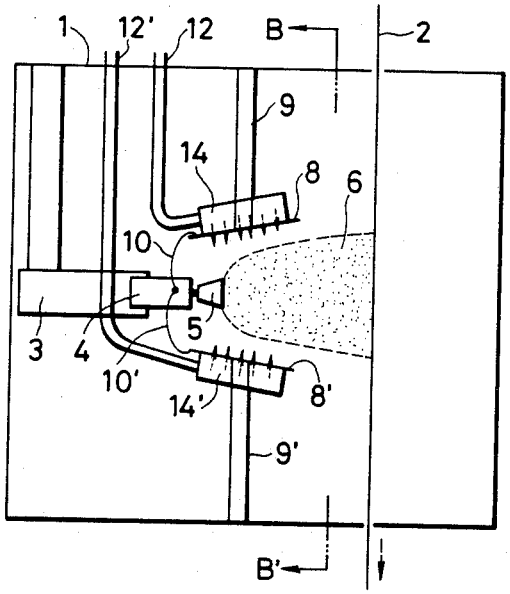
FIG. 8 is a schematic side view showing the rotary electrostatic spraying apparatus according to a further embodiment of the present invention.
Figure 9:
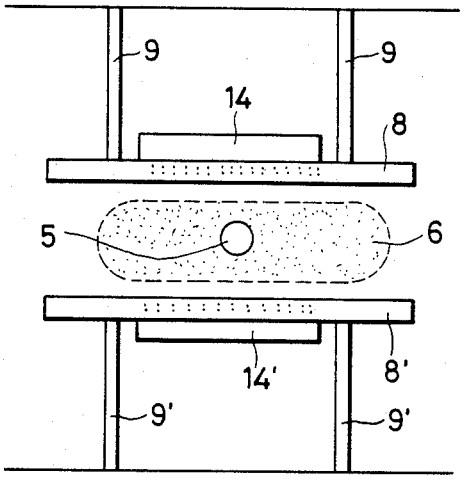
FIG. 9 is a front view of the apparatus of FIG. 8 as seen in the direction indicated by arrows B—B'.

Another embodiment of the rotary electrostatic spraying apparatus of the present invention is shown in FIGS. 8 and 9. This embodiment is characterized by the provision of an air chamber 14 (14') mounted on the back side and around the center of a perforated electrode plate 8(8') in the transverse direction thereof. By this arrangement, an air stream is fed through the electrode plate 8 (8') in the direction perpendicular to that plate.

Figure 10:
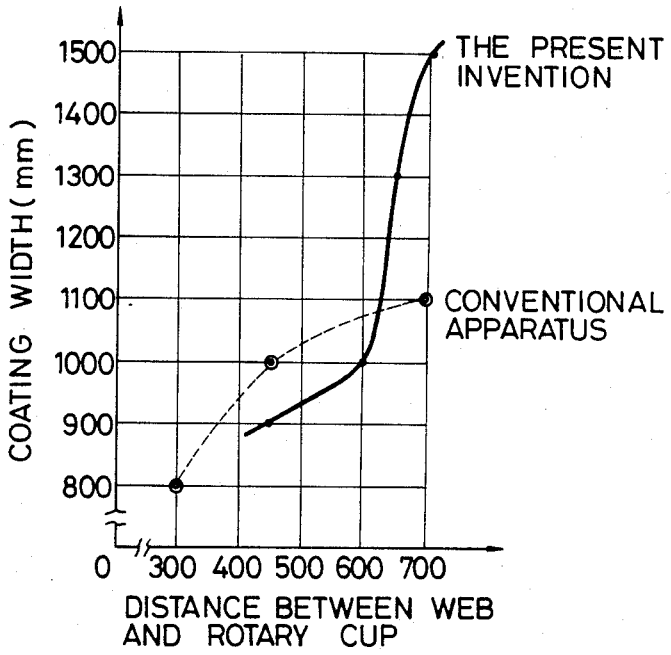
FIG. 10 is a graph showing the results of spraying experiments conducted with the conventional apparatus of FIG. 1 and the improved apparatuses of FIGS. 4 and 8 according to the present invention.

The advantages of the apparatus of the present invention will become more apparent from the following examples in conjunction with one comparative example showing the results of the conventional technique. All results are shown in FIG. 10, wherein the distance between the target and rotary cup is plotted on the x-axis and the coating width on the y-axis.

Comparative Example

Electrostatic spraying was effected with an apparatus of the type shown in FIG. 1 under the following conditions:

| | |
|---|---|
| (1) Substrate: | aluminum web 1,500 mm wide |
| (2) Rotary cup: | a bell-shaped cup (diameter: 2.875 inches) made by the Ransburg Corporation |
| (3) Distance between substrate and rotary cup: | 300–700 mm |
| (4) Rotating speed of cup: | 21,000 rpm |
| (5) Voltage applied to rotary cup: | −90 kV |
| (6) Paint: | water-base paint (solid concentration: 20%) |
| (7) Atomization rate: | 14 $cm^3$/min |

The results are indicated by the dashed line in FIG. 10. As the distance between the web and rotary cup was increased from 300 mm to 700 mm, the coating width expanded from 800 mm to 1,100 mm, but the deposition was uneven in the transverse direction of the web as shown in FIG. 3.

EXAMPLE 1

Electrostatic spraying was effected with an apparatus of the type shown in FIGS. 4 and 5 under the following conditions:

| | |
|---|---|
| (1) Substrate: | aluminum web 1,500 mm wide |
| (2) Rotary cup: | a bell-shaped cup (diameter: 2.875 inches) made by the Ransburg Corporation |
| (3) Distance between substrate and rotary cup: | 450–700 mm |
| (4) Size of paint repelling electrode plates: | 500 mm long, 2,000 mm wide |
| (5) Position of paint repelling electrode plates: | 300 mm above and below the rotary cup, apart from the substrate by 400 mm |
| (6) Size of air outlets: | 5 mm high, 1,000 mm wide |
| (7) Rotating speed of rotary cup: | 21,000 rpm |
| (8) Voltage applied to rotary cup: | −90 kV |
| (9) Paint: | water-base paint (solid concentration: 20%) |
| (10) Atomization rate | 14 $cm^3$/min |
| (11) Linear velocity of the air current: | 14 m/min |

The results are as indicated by the solid line in FIG. 10. When the rotary cup was apart from the substrate by a distance of 700 mm, the coating width was 1,500 mm and the deposition was uniform throughout the width of the web.

EXAMPLE 2

Electrostatic spraying was effected with an apparatus of the type shown in FIGS. 8 and 9. The spray conditions were the same as those used in Example 1 except for the following:

| | |
|---|---|
| (6) Size of holes made in each paint repelling electrode plates: | 1 mm |
| Distance between holes: | 3 mm |
| Perforated area | 300 mm long, 600 mm wide |
| (11) Linear velocity of air current: | 0.5 m/sec |

The results were almost the same as those obtained in Example 1.

As will be apparent from the above data, the electrostatic spraying machine of the present invention has a simple construction, and a single machine is capable of depositing a continuous coating on a travelling broad metal web, which coating is uniform in the transverse direction of the web. As attendant advantages, the repelling electrode plates combined with the air currents keep the spray booth clean and tidy.

It should be understood that the present invention is not limited to the illustrated examples and various modifications can be made without departing from the scope of the invention. For example, the article to be coated may assume any shape if it is electrically conductive. The rotary cup may not only be bell-shaped but may also be a disc or gun type. The paint may be either water or organic solvent based, or other charged particle coatings may be employed. The apparatus of the present invention can be operated under various conditions. With the type of the apparatus shown in FIGS. 8 and 9, the holes made in the repelling electrode plates may be elliptical, rectangular or in slit form. These shapes may be combined with one another or with circular forms. Such modifications are of course included within the scope of the present invention.

What is claimed is:

1. A rotary electrostatic spraying apparatus, comprising: means for spraying charged particles of a coating material onto a traveling substrate, and including electrode plates positioned along the path of the flying particles for providing an electric field repelling said particles, and means for forming an air stream in front of each of said electrode plates in a transverse direction thereto, said substrate passing in a direction transverse to the positioning of said electrode plates, said substrate having a width greater than the distance between said electode plates.

2. A rotary electrostatic spraying apparatus according to claim 1, wherein said air stream forming means comprises an air blowing tube attached to one end of each of said electrode plates for blowing air across said plates.

3. A rotary electrostatic spraying apparatus according to claim 1, wherein said air stream forming means comprises an air chamber mounted on the back side of each of said electrode plates, said electrode plates being perforated so as to establish an air flow normal to said plates.

4. A rotary electrostatic spraying apparatus according to claim 3, said electrode plates being perforated at least proximate a central portion thereof.

5. A rotary electrostatic spraying apparatus according to claim 1, said air stream being formed at least proximate a central portion of each electrode plate.

* * * * *